US007480962B2

(12) United States Patent
Takamatsu et al.

(10) Patent No.: US 7,480,962 B2
(45) Date of Patent: Jan. 27, 2009

(54) SLIDE HINGE

(75) Inventors: Shingo Takamatsu, Chiba (JP); Kazuyoshi Oshima, Chiba (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 205 days.

(21) Appl. No.: 10/555,731

(22) PCT Filed: Apr. 28, 2004

(86) PCT No.: PCT/JP2004/006145

§ 371 (c)(1),
(2), (4) Date: Nov. 7, 2005

(87) PCT Pub. No.: WO2004/099538

PCT Pub. Date: Nov. 18, 2004

(65) Prior Publication Data

US 2007/0084017 A1 Apr. 19, 2007

(30) Foreign Application Priority Data

May 7, 2003 (JP) ..... 2003-129557

(51) Int. Cl.
*E05D 5/00* (2006.01)

(52) U.S. Cl. ..... 16/382; 16/258; 16/272

(58) Field of Classification Search ..... 16/382–384, 16/272, 258, 261, 264, 387, DIG. 40, DIG. 43; 411/358

See application file for complete search history.

(56) References Cited

U.S. PATENT DOCUMENTS 3,864,786 A * 2/1975 Salice ..... 16/278

(Continued)

FOREIGN PATENT DOCUMENTS

DE 2833120 2/1980

(Continued)

OTHER PUBLICATIONS

International Search Report for PCT/JP2004/006145 (2 pages).

(Continued)

*Primary Examiner*—Chuck Y. Mah
(74) *Attorney, Agent, or Firm*—Osha Liang LLP

(57) ABSTRACT

One side portion of an intermediate member 6 is inserted in one side portion of a tubular portion 71 of a fixed member 7 and rotatably coupled to the one side portion of the tubular portion 71 in this state. A vertical slit 71*c* is formed in the other side portion of the tubular portion 71 of a fixed member 7 so as to extend across the tubular portion 71. A lateral slit 71*d* that extends in a circumferential direction of the tubular portion 71 is formed at an intersection portion of the tubular portion 71 and the attachment plate 72 so as to intersect with the vertical slit 71*c* at a center portion of the lateral slit 71*d*. The vertical slit 71*c* and the lateral slit 71*d* define, as a displacement portion 71*e*, 71*e*, a portion that can be displaced to a radial direction outer side of the tubular portion 71. The displacement portion 71*e* is displaced to the outer side by being pressed by a pressing portion 61*c* of the intermediate member 6 when the intermediate member 6 is rotated to an attachment position at which substantially all of a main body 61 of the intermediate member 6 is inserted into the tubular portion 71.

4 Claims, 11 Drawing Sheets

U.S. PATENT DOCUMENTS

| | | | | | |
|---|---|---|---|---|---|
| 4,091,500 | A | * | 5/1978 | Lautenschlager | 16/383 |
| 4,270,240 | A | * | 6/1981 | Zernig et al. | 16/250 |
| 4,361,931 | A | | 12/1982 | Schnelle et al. | |
| 5,239,730 | A | * | 8/1993 | Grass | 16/272 |
| 5,245,727 | A | | 9/1993 | Sasaki | |
| 5,412,841 | A | * | 5/1995 | Lautenschlager et al. | 16/249 |
| 5,548,870 | A | * | 8/1996 | Grass, sen. | 16/254 |
| 5,715,577 | A | * | 2/1998 | Lautenschlager et al. | 16/383 |
| 6,073,311 | A | * | 6/2000 | Lautenschlager | 16/383 |
| 6,081,970 | A | * | 7/2000 | Wasilewski | 16/383 |

FOREIGN PATENT DOCUMENTS

| | | | | |
|---|---|---|---|---|
| DE | 4214979 | | | 4/1993 |
| EP | 552607 | A1 | * | 7/1993 |
| GB | 1381965 | | | 1/1975 |
| JP | 59-4017 | | | 1/1984 |
| JP | 7-4748 | | | 1/1995 |
| JP | 11-2933996 | | | 10/1999 |
| JP | 2000234466 | A | * | 8/2000 |
| NL | 7210903 | | | 3/1973 |

OTHER PUBLICATIONS

European Search Report for Application No. 04730010.8-2311 dated Jul. 17, 2008, 3 pages.

* cited by examiner

SLIDE HINGE

FIELD OF THE INVENTION

The invention relates to a slide hinge that favorably enables a rotating body like a door having a comparatively light weight to be rotatably coupled to a body of a tool or the like.

BACKGROUND OF THE INVENTION

Generally, a slide hinge of this type, as disclosed in Published Examined Patent Application Sho. 59-4017, includes a hinge body attached to an inner surface of a side wall of a body; an intermediate member that is rotatably coupled to a tip end of the hinge body via two links; and a tubular fixed member that is attached to the intermediate member. The fixed member is inserted in a mounting hole formed in an inner surface of a door, and then fixed along with the intermediate member to an attachment hole.

More specifically, a separation groove is formed in one end surface of a periphery wall of the fixed member so as to extend from one side portion of the periphery wall toward the other side portion thereof. As a result of forming this separation groove, a portion of the periphery wall is divided into an inner periphery side portion that is to the inside of the separation groove, and an outer periphery side portion that is to the outside of the separation groove. Both ends of the separation groove in a length direction thereof are open to an outer periphery surface of the periphery wall, whereby the outer side portion is only connected to the inner periphery side region via a joining portion that is provided between a bottom surface of the separation groove and the other end surface of the fixed member. The joining portion is comparatively thin, and is capable of elastic deformation. Thus, the outer periphery side portion can be rotated about the joining portion such that a tip end thereof (an end at the side of the one end surface of the periphery wall) can be displaced to a radial direction outer side of the fixed member. A through hole which opens to the bottom surface of the separation groove and which passes through the joining portion is formed in the other end surface of the fixed member.

The attachment hole is formed in the inner surface of the door for when the fixed member is attached to the door. The fixed member is inserted into the attachment hole from the one end surface side of the fixed member. Then, the intermediate member is pressed into the separation groove via the through hole, whereby the tip end of the outer periphery side portion is displaced to the radial direction outer side. As a result, a wedge protrusion formed in an outer periphery surface of the outer periphery side portion is wedged into an inner periphery surface of the attachment hole. Accordingly, the fixed member is fixed to the attachment hole, and the intermediate member is fixed to the door via the fixed member. Thus, the door is rotatably coupled to the body via the slide hinge.

In the above known slide hinge, the outer periphery side portion and the inner periphery side portion are connected via the joining portion between the bottom surface of the separation groove and the other end surface of the fixed member. Accordingly, for example, if an external force acts on the fixed member so as to remove the fixed member from the attachment hole, stress concentrates in the joining portion. Note that, since the joining portion is thin, when a large external force acts on the fixed member, there is a possibility that the outer periphery side portion and the inner periphery side portion (the fixed member excluding the outer periphery side portion) will break off from the joining portion. To address this, the joining portion may be made thicker to increase its strength. However, if this structure is adopted, it becomes difficult to displace the outer periphery side portion a substantial amount. Further, a wedge depth, which is the depth to which the wedge protrusion formed in the outer periphery side portion is wedged into the inner periphery surface of the attachment hole, is reduced. Accordingly, a different problem arises in that the attachment strength of the fixed member is reduced.

DISCLOSURE OF THE INVENTION

The invention aims to solve the above problems and is characterised by comprising: a hinge body; a tubular fixed member; and an intermediate member that is inserted and fixed to the fixed member at a predetermined attachment position, wherein one of the fixed member and the intermediate member is rotatably coupled to a tip end of the hinge body via two links, a displacement portion is provided in a periphery wall of the fixed member, one end portion of the displacement portion in a circumferential direction being displaceable in a radial direction of the fixed member about the other end portion of the displacement member, an wedge protrusion is provided on an outer periphery surface of the displacement portion, and a pressing portion is provided on an outer surface of the intermediate member, the pressing portion displacing the one end portion of the displacement portion to an outer side of the fixed member when the intermediate member is inserted to the attachment position as a result of the pressing portion abutting with an inner periphery surface of the displacement portion.

With this configuration, a vertical slit may be formed in the periphery wall of the fixed member so as to extend across the periphery wall in an axis line direction thereof As a result, the displacement portion is defined as a neighboring portion in a vicinity of the vertical slit of the periphery wall. Alternatively, a vertical slit may be formed in the periphery wall of the fixed member so as to extend across the periphery wall in an axis line direction thereof from one end surface toward the other end side; and a lateral slit may be formed in the periphery wall of the fixed member so as to extend in a circumferential direction from a tip end portion of the vertical slit. In this case, the displacement portion is a portion defined by the one end surface of the periphery wall, the vertical slit and the lateral slit. Alternatively, a vertical slit may be formed in a middle portion of a periphery wall of the fixed member in an axis line direction so as to extend in the axis line direction of the fixed member; and lateral slits that extend respectively in the same circumferential direction from one end portion and from the other end portion of the vertical slit. In this case, the displacement portion is a portion defined by the vertical slit, and the two lateral slits that extend in the circumferential direction from the respective end portions.

Further, it is preferable that one side portion of the intermediate member is rotatably coupled to one side portion of the fixed member such that the intermediate member can be rotated between the attachment position and a stand-by position at which the other side portion of the intermediate member is removed from the fixed member. Further, it is preferable that a holding protrusion is formed in the one side portion of the intermediate member, the holding protrusion protruding from the fixed member toward an outer side thereof when the intermediate member is rotated to the attachment position.

BEST MODE FOR CARRYING OUT THE INVENTION

Figure 1:
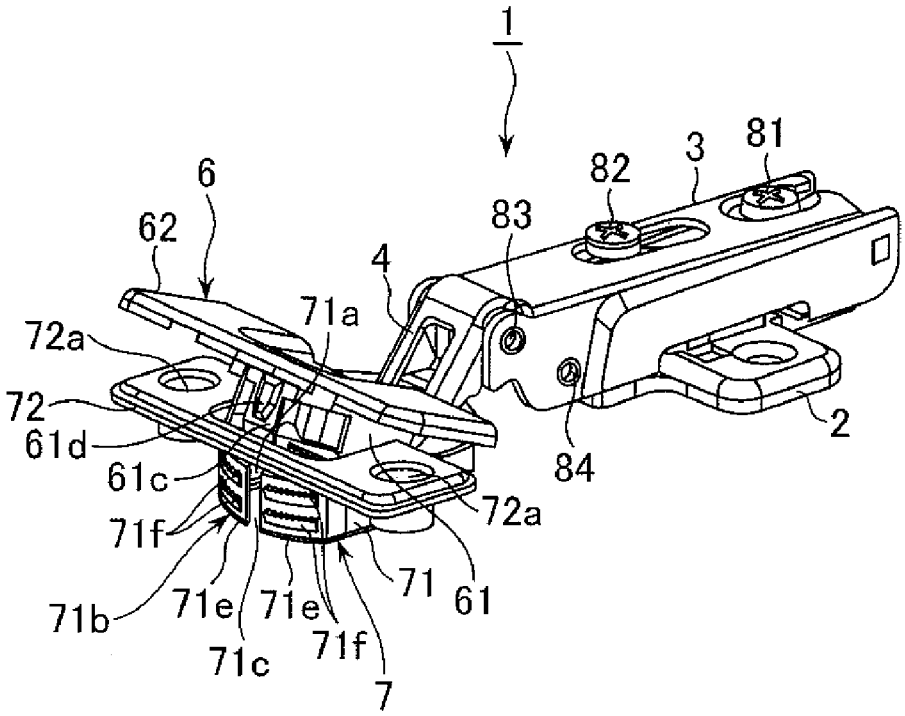
FIG. 1 is a perspective view showing a first embodiment of the invention when an intermediate member is positioned in a stand-by position.
Figure 2:
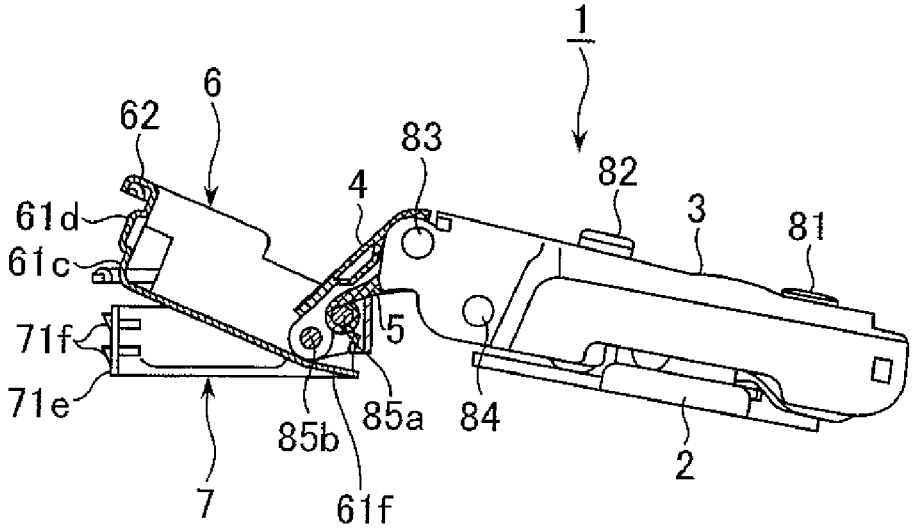
FIG. 2 is a partially cut out side view of the same embodiment when the intermediate member is positioned in the stand-by position.
Figure 3:
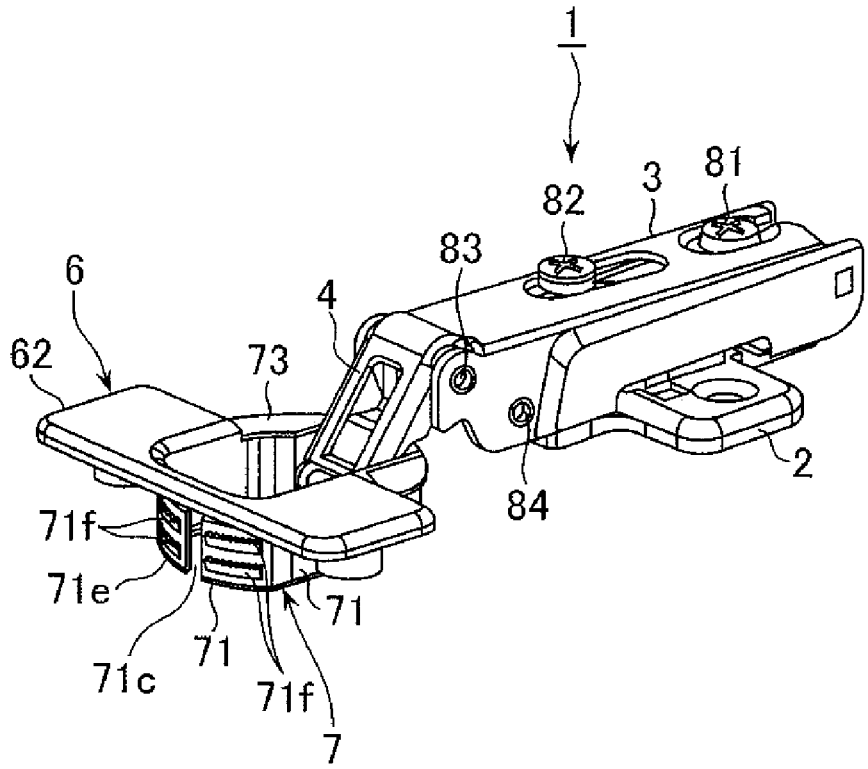
FIG. 3 is a perspective view showing the same embodiment when the intermediate member is positioned in an attachment position.
Figure 4:
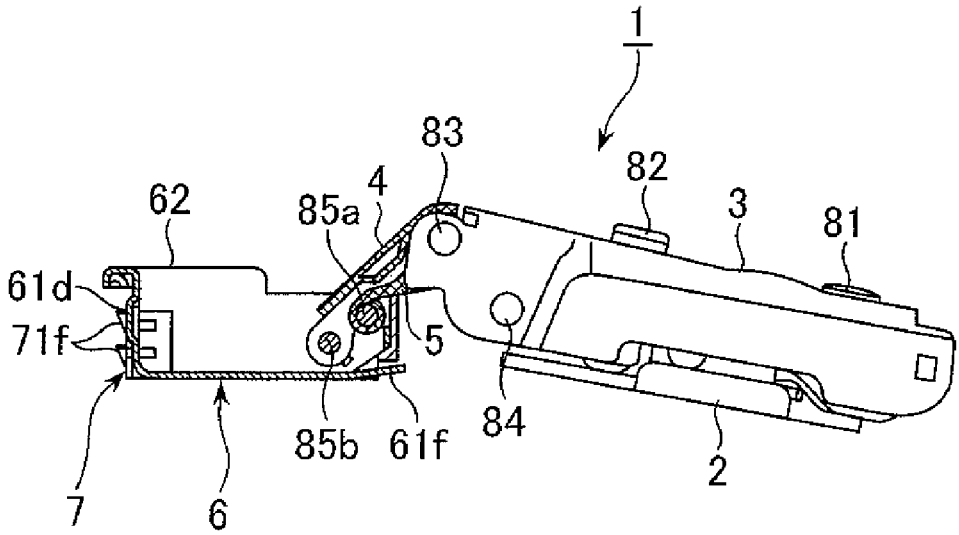
FIG. 4 is a partially cut out side view of the same embodiment when the intermediate member is positioned in the attachment position.
Figure 5:
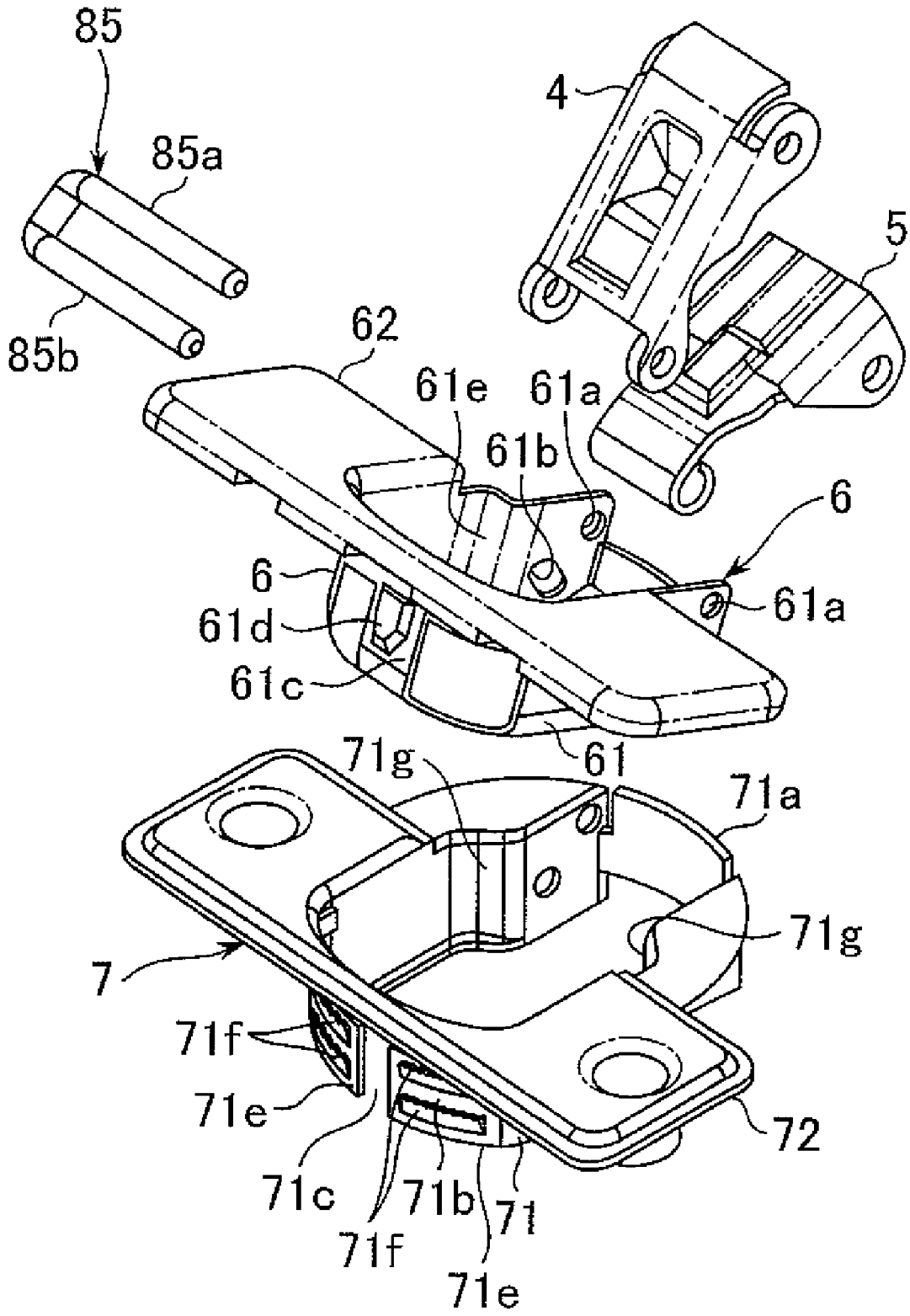
FIG. 5 is an exploded perspective view showing a main portion of the same embodiment.

Hereinafter, embodiments of the invention will be described with reference to FIGS. 1 to 26.

FIGS. 1 to 20 show a first embodiment of the invention. In this embodiment, a slide hinge 1 includes, as shown in FIGS. 1 to 4, an attachment member 2, a hinge body 3, two links 4, 5, an intermediate member 6 and a fixed member 7.

The attachment member 2 is fixed to an inner surface of a side wall of a body (not shown) such as a piece of furniture, or the like, by a screw (not shown). The hinge body 3 is removably attached to the attachment member 2 by screws 81, 82. Respective one ends of the links 4, 5 are rotatably coupled to a tip end of the hinge body 3 via shafts 83 and 84 that are arranged parallel to each other.

As can be seen from FIGS. 1 to 7 and FIGS. 15 to 20, the intermediate member 6 has a main body 61 with a bottomed tubular shape. Insertion holes 61*a*, 61*a* and long holes 61*b*, 61*b* are formed in one side portion of the main body 61 that is at a side in a direction orthogonal to the axis line thereof, the insertion holes 61*a*, 61*a* having an axis that extends in a direction orthogonal to an axis line of the main body 61, and the long holes 61*b*, 61*b* being formed to extend in arc-like shapes that center on the insertion holes 61*a*, 61*a*. A U-shaped connecting member 85 has two shafts 85*a*, 85*b* that are arranged parallel to the shafts 83 and 84. One of the two shafts, the shaft 85*a*, is rotatably inserted into the insertion holes 61*a*, 61*a*, and the other of the shafts, the shaft 85*b*, is inserted in the long holes 61*b* so as to capable of movement in a lengthwise direction of the long holes 61*b*. Other ends of the links 4, 5 are rotatably coupled to the shafts 85*a*, 85*b*. Accordingly, the intermediate member 6 can be rotated about the shaft 85*a* with respect to the links 4, 5 in a range that is determined by the lengthwise direction movement that the shaft 85*b* is capable of within the long hole 61*b*. A cover 62 is formed integrally with the main body 61 at an other side portion of the end of an opening side of the main body 61.

Figure 6:
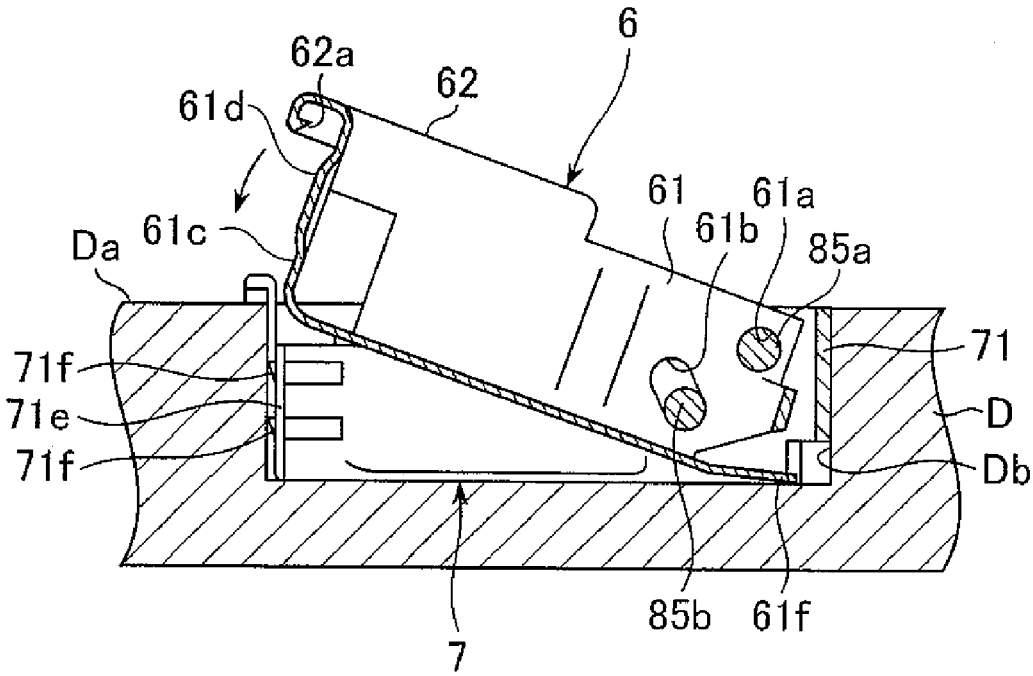
FIG. 6 is an expanded cross section view of the main portion of the same embodiment showing a state just before the intermediate member and the fixed member are fixed to an attachment hole of a door.
Figure 7:
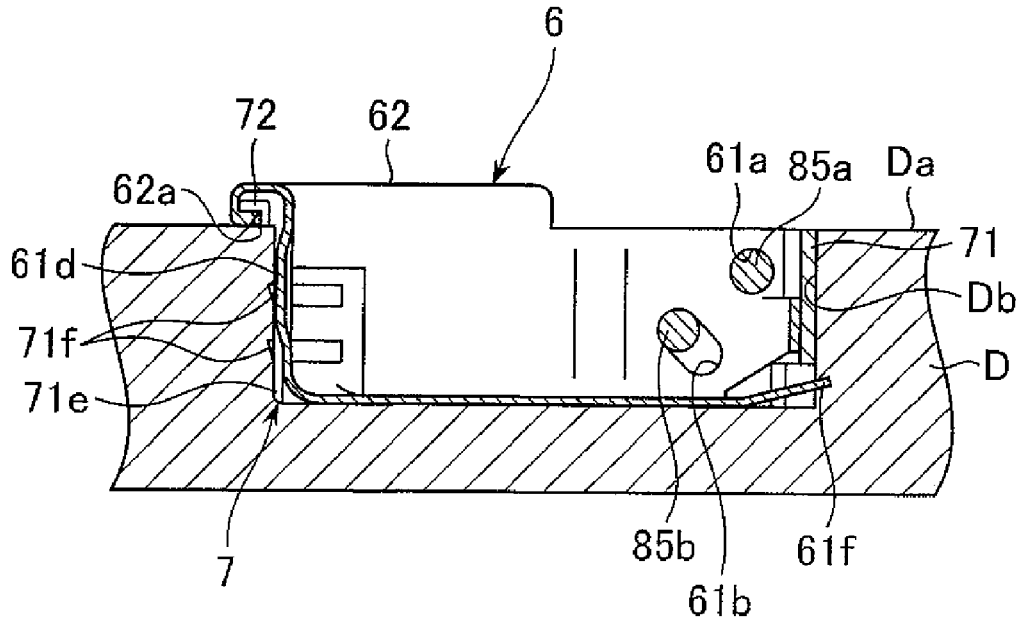
FIG. 7 is an expanded cross section view of the main portion of the same embodiment showing a state when the intermediate member and the fixed member have been fixed to the attachment hole of the door.
Figure 8:
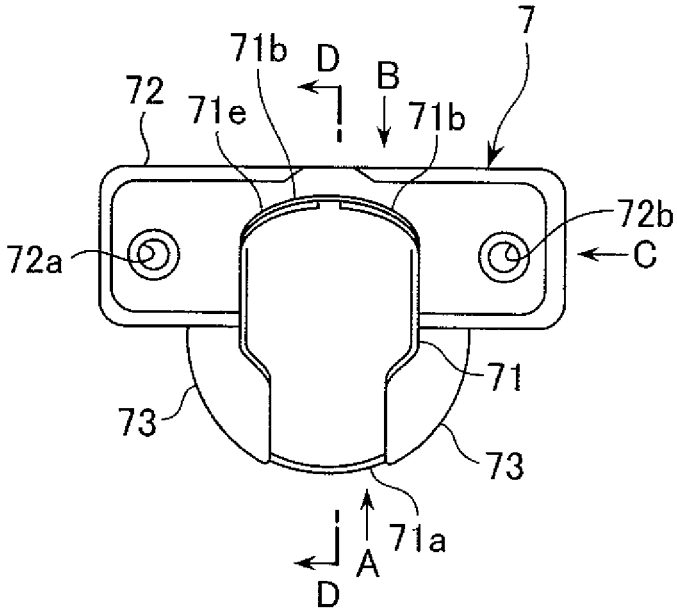
FIG. 8 is a plan view showing the fixed member used in the same embodiment.
Figure 9:
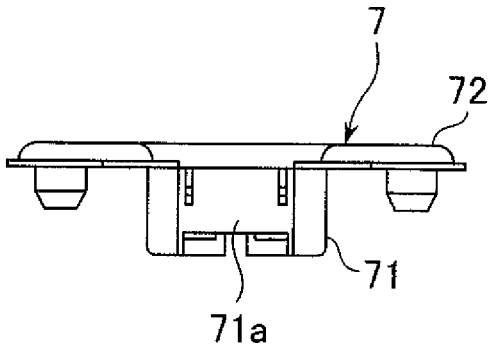
FIG. 9 is a view along arrow A of FIG. 8.
Figure 10:
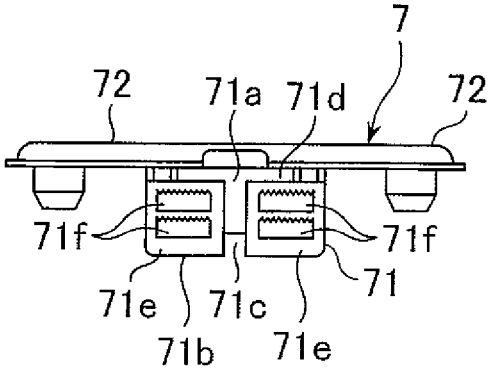
FIG. 10 is a view along arrow B of FIG. 8.
Figure 11:
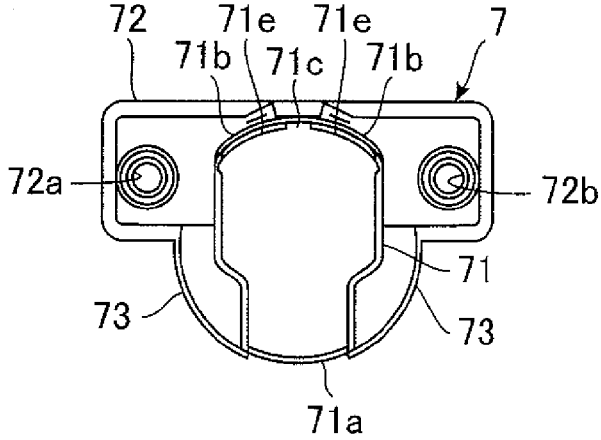
FIG. 11 is a lower surface view of the fixed member.
Figure 12:
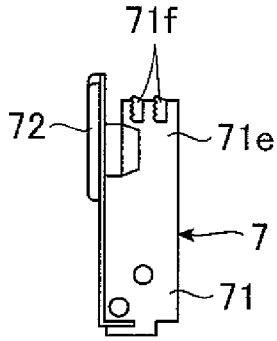
FIG. 12 is a view along arrow C of FIG. 8.
Figure 13:
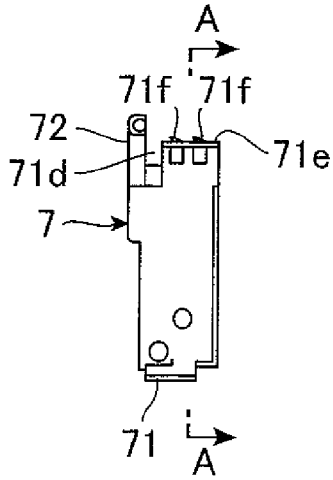
FIG. 13 is a cross section view along line D-D of FIG. 8.
Figure 14:
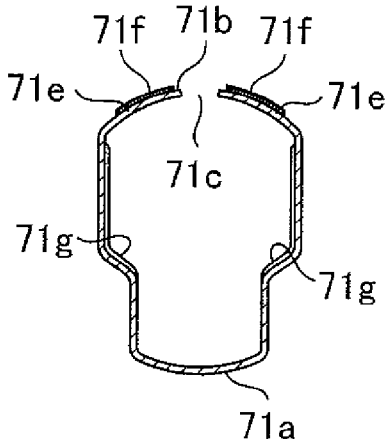
FIG. 14 is a cross section view along line A-A of FIG. 13.
Figure 15:
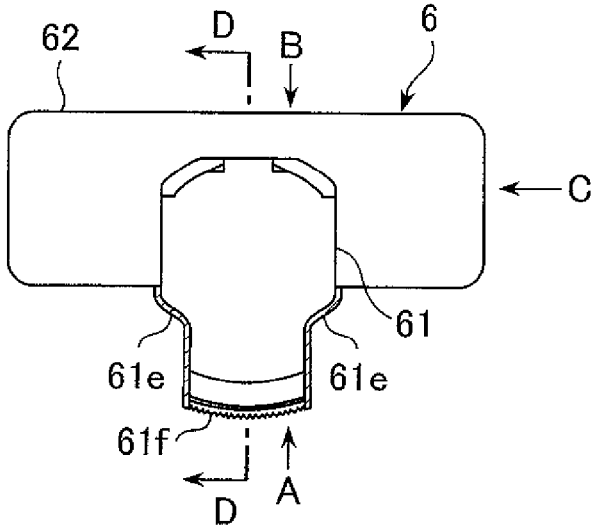
FIG. 15 is a plan view showing the intermediate member used in the same embodiment.
Figure 16:
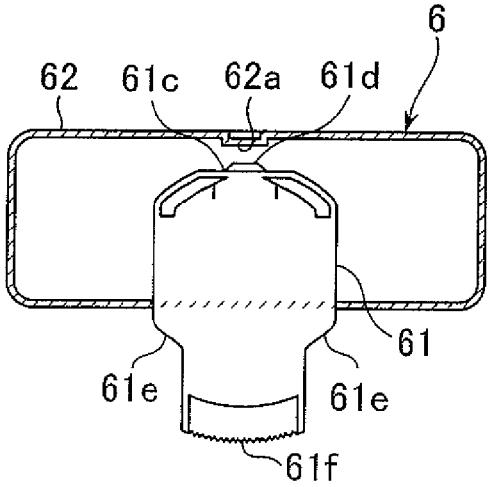
FIG. 16 is a lower surface view of the intermediate member.
Figure 17:
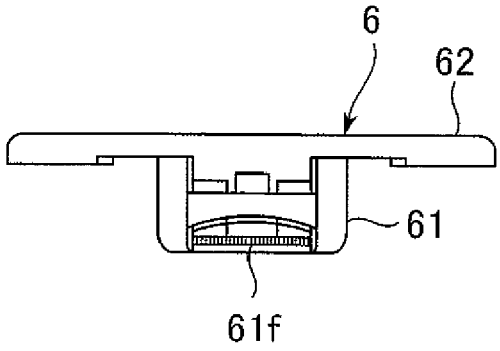
FIG. 17 is a view along arrow A of FIG. 15.
Figure 18:
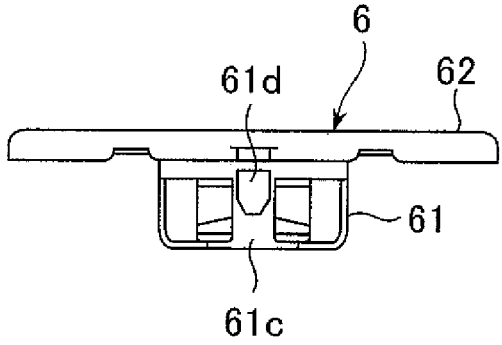
FIG. 18 is a view along arrow B of FIG. 15.
Figure 19:
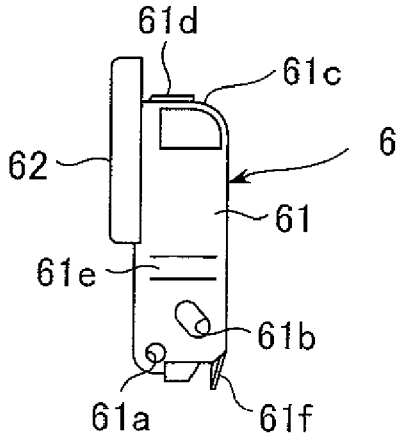
FIG. 19 is a view along arrow C of FIG. 15.
Figure 20:
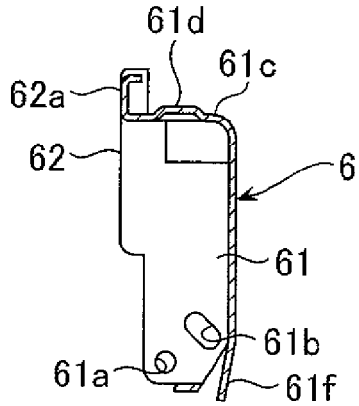
FIG. 20 is a cross section view along line D-D of FIG. 15.

As is apparent from FIGS. 1 to 14, the fixed member 7 has a tubular portion 71 with two open ends. One side portion of the intermediate member 6 is inserted in one side portion of the tubular portion 71 that is at a side in a direction orthogonal to the axis line thereof. Further, the shafts 85*a*, 85*b* of the connecting member 85 are also inserted in the one side portion of the tubular portion 71 so as to be rotatable in the direction orthogonal to the axis line of the tubular portion 71. As a result, the fixed member 7 is coupled to the hinge body 3 via the two links 4, 5 in a rotatable manner. Moreover, because the intermediate member 6 is rotatable with respect to the links 4, 5, the fixed member 7 is capable of relative rotation with respect to the intermediate member 6 about the shaft 85*a*. As can be seen in FIG. 6, before the fixed member 7 is fixed to the door (rotating body) D, the shaft 85*b* is positioned at one end of the long hole 61*b*, and the intermediate member 6 is positioned at a stand-by position where the other side portion of the intermediate member 6 is positioned away from the other side portion of the fixed member 7. When the fixed member 7 is fixed to the door D, as can be seen in FIG. 7, the shaft 85*b* is positioned at the other end of the long hole 61*b*, and the main body 61 of the intermediate member 6, including the other side end thereof, is almost completely inserted within the fixed member 7. At this time, a rotation position of the intermediate member 6 with respect to the fixed member 7 is at an attachment position.

The other side portion of the tubular portion 71 at one end thereof in the axis line direction is formed with an attachment plate 72 that substantially forms a right angle with the axis line of the tubular portion 71. This attachment plate 72 is used when the door D is comparatively heavy. An insertion hole 72*a* formed in the attachment plate 72, and a screw (not shown) is inserted therein. This screw is screwed into the door D to fix the attachment plate 72 to the door D, and, by extension, to fix the fixed member 7 to the door D. The attachment plate 72 is not fixed to the door D when the door D is light. Thus, it is not essential to provide the attachment plate 72. The one side portion at one end of the tubular portion 71 is formed with an auxiliary plate 73 that substantially forms a right angle with the axis line of the tubular portion 71.

The main body 61 of the intermediate member 6 and the tubular portion 71 of the fixed member 7 are inserted and fixed to an attachment hole Db formed in an inner surface Da of the door D. The depth of the attachment hole Db is set to be substantially equal to a length in the axis line direction of the main body 61 and the tubular portion 71. Accordingly, the tubular portion 71 is inserted into the attachment hole Db until the other end portion in the axis line direction of the tubular portion 71 comes into contact with the bottom surface of the attachment hole Db. At this time, the attachment plate 72 abuts with the inner surface Da of the door D. Further, when the intermediate member 6 is rotated to the attachment position from the stand-by position, a bottom portion of the main body 61 is substantially placed in contact with the bottom surface of the attachment hole Db, and the cover 62 abuts with the inner surface Da of the door D. Note that, the cover 62 is formed to be bigger than the attachment plate 72, and thus covers the whole of the attachment plate 72. In order to fix the intermediate member 6 and the fixed member 7 to the attachment hole Db, the structure described below is adopted.

As shown in FIGS. 5 to 14, arced sections 71*a*, 71*b* are formed in the tubular portion 71 of the fixed member 7 at points 180 degrees apart from each other in the circumferential direction. Respective outer periphery surfaces of the arced sections 71*a*, 71*b* have the same center of curvature and the same radius of curvature. In other words, the outer periphery surfaces of the arced sections 71*a*, 71*b* are formed by the same arc profile. The center of curvature of the arced sections 71*a*, 71*b* is parallel with or the same as the axis line of the tubular portion 71. The radius of curvature of the arced sections 71*a*, 71*b* is slightly smaller than the radius of the attachment hole Da. A vertical slit 71*c* that extends across the arced section 71*b* (the tubular portion 71) in the axis line direction of the fixed member 7 is provided at a central portion in a circumferential direction of the arced section 71*b* formed in the other side portion of the fixed member 7. Further, a lateral slit 71*d* which intersects with the vertical slit 71*c* and which extends along the arced section 71*b* from one end to the other end thereof is formed at an intersection portion of the arced section 71*b* and the attachment plate 72.

The vertical slit 71*c*, the lateral slit 71*d* and the other end surface of the tubular portion 71 divide the arced section 71*b* in two respective sections, namely, displacement portions 71*e*. One end of each displacement portion 71*e* that neighbors on the vertical slit 71*c* is capable of elastic displacement in the radial direction of the arced section 71*b* about the other end in the circumferential direction (the end that is positioned at substantially the same position in the circumferential direction as the end of the lateral slit 71*d*). Extending protrusions (wedge protrusions) 71*f* are formed in the circumferential direction in the outer periphery surface of each displacement portion 71*e*. Each protrusion 71*f* has a triangular cross section, and a height that is set to be substantially equal to the difference between an internal radius of the attachment hole Db and a diameter of the arced sections 71*a*, 71*b*. Accordingly, when the tubular portion 71 is inserted into the attachment hole Db, the outer periphery surface of the arced section 71*a* and respective tip ends of the protrusions 71*f* in the height direction abut with an inner periphery surface of the attachment hole Db. A side surface of the protrusion 71*f* that faces the attachment plate 72 side is formed so as to form a right angle with the axis line of the tubular portion 71. However, the side surface may be formed to incline along its length toward the radial direction outer side of the displacement portion 71*e*. As a result of this configuration, the side surface is formed to slightly incline toward the attachment plate 72 side. The side surface of the protrusion 71*f* on the attachment plate 72 side is formed with a jagged shaped.

Respective abutting portions 71*g* are formed at two points at positions between the arced sections 71*a*, 71*b* of an inner periphery surface of the tubular portion 71. The abutting portions 71*g* face toward the arced section 71*b* side. Further, the abutting portions 71*g* extend parallel to the axis line of the tubular portion 71.

On the other hand, a pressing portion 61*c* is formed in an outer periphery surface of the main body 61 of the intermediate member 6. This pressing portion 61*c* is provided on the other side portion where the cover 62 of the main body 61 is formed and is positioned opposite to the vertical slit 71*c*. A width of the pressing portion 61*c* in the circumferential direction is wider than a width of the vertical slit 71*c*. When the intermediate member 6 is rotated to the attachment position, both ends in the circumferential direction of the pressing portion 61*c* are placed into contact with points in the vicinity of the vertical slit 71*c* of the inner periphery surface of the displacement portions 71*e*, 71*e*. A central area in the circumferential direction of the pressing portion 61*c* is formed with a protrusion 61*d*. A width in the circumferential direction of the protrusion 61*d* is slightly wider than the width of the vertical slit 71*c*.

Abutting portions 61*e*, 61*e* are formed in an outer periphery surface of the main body 61. The abutting portions 61*e*, 61*e* extend in the axis line direction of the main body 61, and are positioned such that they come into surface contact with the respective abutting portions 71*g*, 71*g* of the fixed member 7 when the intermediate member 6 is rotated to the attachment position. Further, when the intermediate member 6 is rotated to the attachment position and the abutting portions 61*e* contact with the abutting portions 71*g*, the pressing portion 61*c* is placed in contact with a point in the vicinity of the vertical slit 71*c* of the displacement portions 71*e*, 71*e* so as to apply pressure to the point. More specifically, when the intermediate member 6 is rotated to the attachment position, the pressing portion 61*c* and the abutting portions 61*e*, 61*e* press between the displacement portions 71*e*, 71*e* of the fixed member 7 and the abutting portions 71*g*, 71*g*. As a result, the pressing portion 61*c* exerts pressure on the displacement portions 71*e*, 71*e* toward the radial direction outer side of the arced section 71*b*. Accordingly, the displacement portions 71*e* deform elastically about a base end thereof (the end away from the vertical slit 71*c*), and the tip ends of the displacement portions 71*e* are displaced toward the radical direction outer side of the arced section 71*b*. A displacement amount of the displacement portions 71*e* is substantially equal to a difference between the internal radius of the attachment hole Db and the outer radius of the arced section 71*b* at the end on the vertical slit 71*c* side. Accordingly, when the intermediate member 6 is rotated to the attachment position, as shown in FIG. 7, the displacement portions 71*e* of the fixed member 7 are placed into contact with the inner periphery surface of the attachment hole Db so as to exert pressure thereto, and the protrusion 71*f* is wedged into the inner periphery surface of the attachment hole Db. As a result, the other side portion of the fixed member 7 is fixed in an immovable manner to the attachment hole Db in the axis direction thereof. Further, as the protrusion 71*f* is wedged into the inner periphery surface of the attachment hole Db, the side surface of the protrusion 71*f* formed with the jagged shape is also wedged into the inner periphery surface of the attachment hole Db. Accordingly, rotation with respect to the attachment hole Db of the fixed member 7 is inhibited. Displacement of the displacement portions 71*e*, 71*e* toward the outer side is accompanied by a slight widening of the width of the vertical slit 71*c*, and the protrusion 61*d* is tightly fitted into the vertical slit 71*c*. Accordingly, the shape of the displacement portion 71*e* is inhibited from elastically returning toward the radial direction inner side of the tubular portion 71.

As can be seen from FIGS. 6 and 7, an engagement tab 62*a* is formed on an inner surface of the other side portion of the cover 62 of the intermediate member 6. When the intermediate member 6 is rotated to the attachment position, the engagement tab 62*a* engages with the other side portion of the attachment plate 72 of the fixed member 7. Thus, the other side portion of the intermediate member 6 is held to the other side portion of the fixed member 7 so as to be immovable in a direction away from the front surface Da of the door D (an upward direction in FIGS. 6 and 7). Further, the cover 62 of the intermediate member 6 abuts with the front surface Da of the door D. As a result, the other side portion of the intermediate member 6 is fixed to the door D via the other side portion of the fixed member 7.

A protruding plate (holding protrusion) 61*f* is formed at one side portion of an end at a bottom portion side of the main body 61 of the intermediate member 6. This protruding plate 61*f* protrudes to the outside from an outer periphery surface of the one side portion of the main body 61. Further, when the intermediate member 6 is rotated to the attachment position, the protruding plate 61*f* protrudes outwards from the tubular portion 71 of the fixed member 7, and wedges into the inner periphery surface of the attachment hole Db. Accordingly, the one side portion of the intermediate member 6 is attached to the attachment hole Db so as to be immovable in the axis direction thereof. Moreover, the protruding plate 61*f* is formed to incline along its length from a base end side to a tip end side thereof. As a result of this configuration, the protruding plate 61*f* is formed to incline toward an opening side of the main body 61. Thus, the strength with which the one side portion of the intermediate member 6 is attached to the door D is increased. Further, a tip end surface of the protruding plate 61*f* is formed in a jagged shape. Accordingly, when the protruding plate 61*f* is wedged into the inner periphery surface of the attachment hole Da, rotation with respect to the attachment hole Db of the intermediate member 6 is inhibited.

With this configuration, when the intermediate member 6 is rotated to the attachment position, the one side portion of the intermediate member 6 and the other side portion of the fixed member 7 are respectively fixed to the attachment hole Db. Further, the intermediate member 6 and the fixed member 7 are inter-coupled by the engagement tab 62*a* and the shaft 85*a*. Accordingly, the intermediate member 6 and the fixed member 7 are fixed to the attachment hole Db in an inter-coupled state, and, by extension, are fixed to the door D.

In the above described configuration of the hinge device 1, the base ends of the displacement portions 71*e* are contiguous with a periphery direction of a periphery wall of the tubular portion 71. Thus, when the displacement portions 71*e* are displaced toward the radial direction outer side of the arced section 71*b*, and force acts on the fixed member 7 in the axis line direction thereof, there is no concentration of stress in the base ends of the displacement portions 71*e*. Further, a width of the base ends of the displacement portions 71*e* in the axis line direction of the fixed member 7 can be set to be the same as the length of the tubular portion 71. By doing so, the width is made adequately large, and the base ends of the displacement portions 71*e* are provided with a sufficiently high degree of strength. Accordingly, it is possible to inhibit the occurrence of events such as when the displacement portions 71*e* break away from its base portion.

Next, other embodiments of the invention will be explained. Note that, only structure that differs from that of the embodiment described above will be explained. Accordingly, structural members that are the same are denoted with the same reference numerals and an explanation thereof is omitted.

Figure 21:
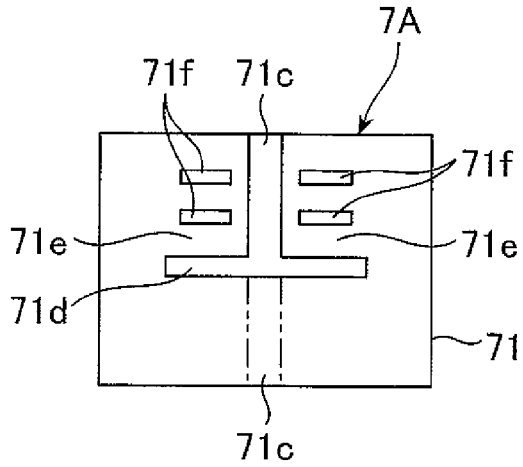
FIG. 21 is a front view showing a modified form of the fixed member according to the invention.

FIG. 21 shows a modified form of the fixed member used in the hinge device 1. In this fixed member 7A, the attachment plate 72 is not formed in the one end portion of the tubular portion 71 (a top end in FIG. 21). Accordingly, the lateral slit 71*d* is not formed to extend in the circumferential direction at the intersection portion of the tubular portion 71 and the attachment plate 72. Further, the vertical slit 71*c* is not formed to extend across the tubular portion 71, and instead extends from the one end surface of the tubular portion 71 to a middle portion thereof. The lateral slit 71*d* is formed to extend in the circumferential direction in the middle portion of the tubular portion 71. This lateral slit 71*d* intersects at a center position thereof with an end on the other end side of the vertical slit 71*c*. The displacement portions 71*e*, 71*e* are the portions defined by the vertical slit 71*c*, the lateral slit 71*d*, and the one end surface of the tubular portion 71. Note that, as shown by the phantom lines of FIG. 21, the vertical slit 71*c* may be formed to extend from the other side surface of the tubular portion 71 as far as the middle portion thereof, with the vertical slit 71*c* extending toward the one end surface. With this configuration, the displacement portions 71*e*, 71*e* are the portions defined by the vertical slit 71*c* the lateral slit 71*d* and the other end surface of the tubular portion 71.

Figure 22:
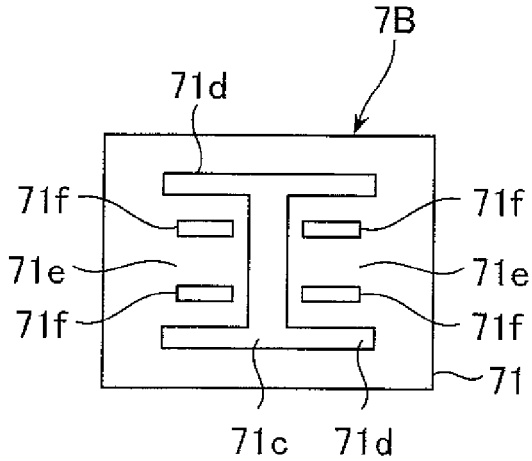
FIG. 22 is a front view showing another modified form of the fixed member according to the invention.
Figure 23:
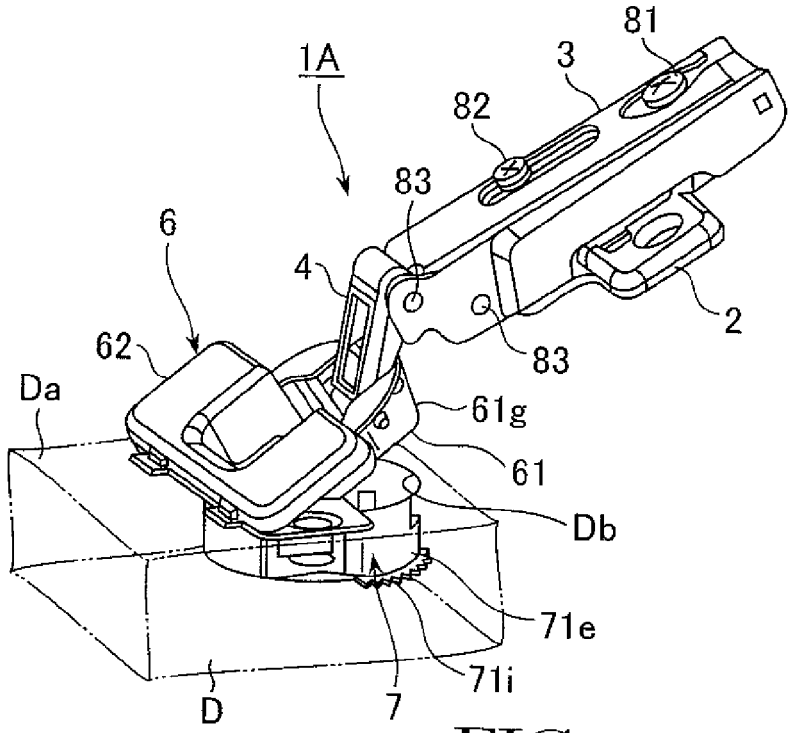
FIG. 23 is a partially transparent perspective view of another embodiment of the invention that shows a state just before the intermediate member and the fixed member are fixed to an attachment hole.
Figure 24:
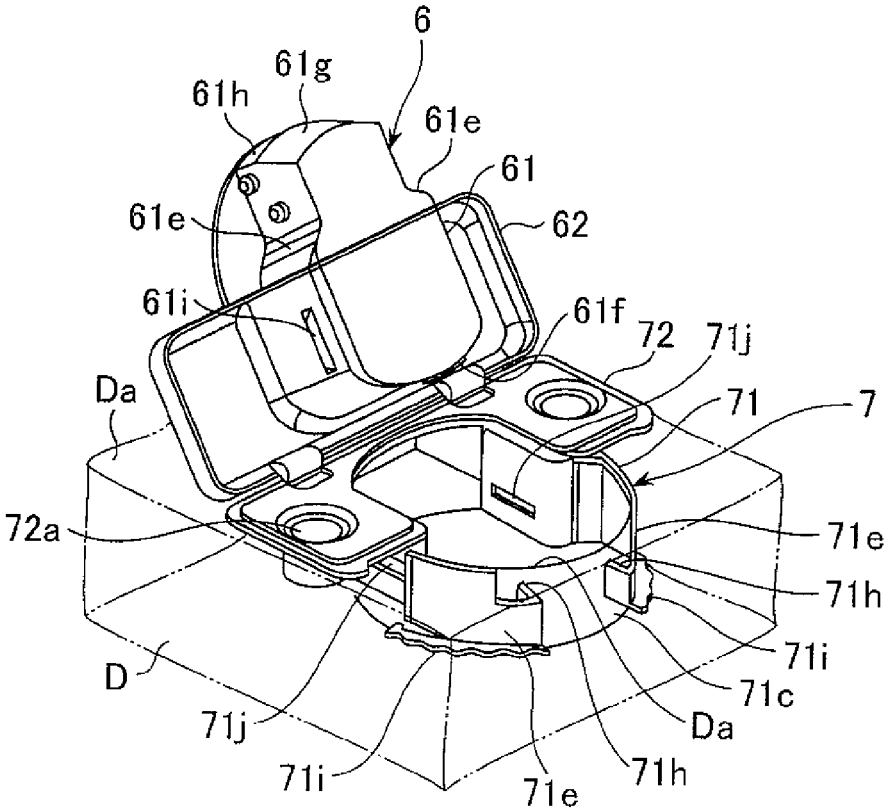
FIG. 24 is a similar view to FIG. 23 and shows a main portion of the same embodiment.
Figure 25:
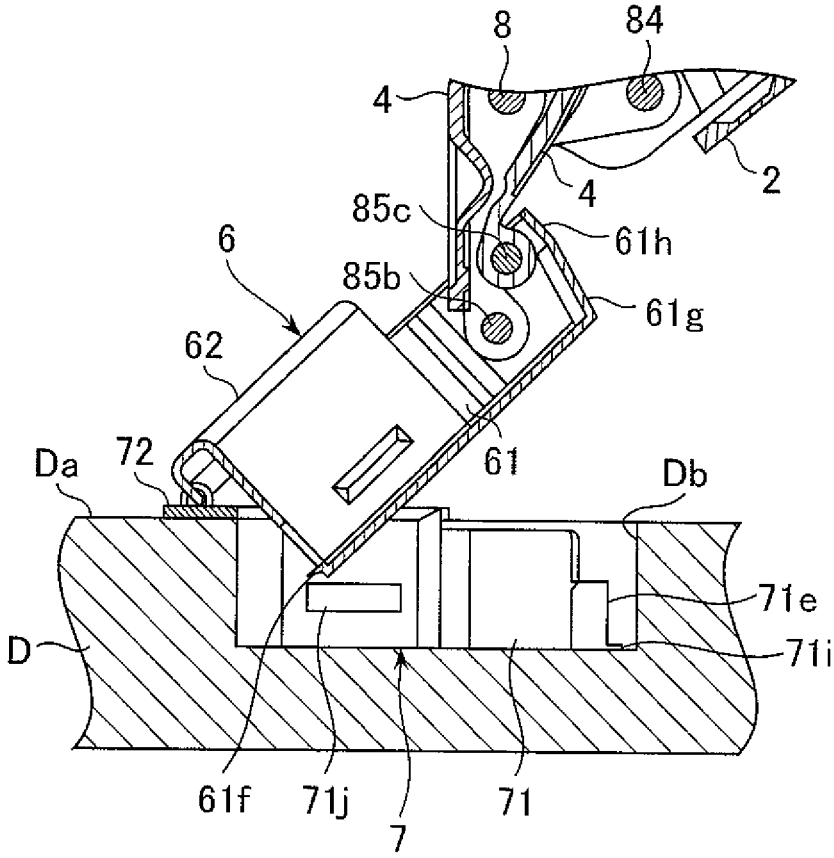
FIG. 25 is a cross section view of the main portion of the same embodiment showing a state just before the intermediate member and the fixed member are fixed to the attachment hole.
Figure 26:
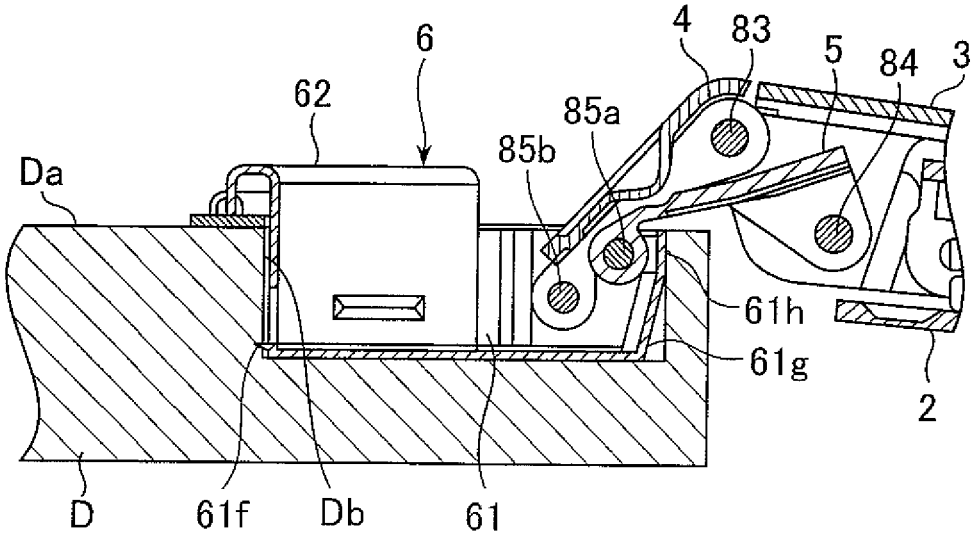
FIG. 26 is a cross section view of the main portion of the same embodiment showing a state when the intermediate member and the fixed member have been fixed to the attachment hole.

FIG. 22 shows another modified form of the fixed member used in the hinge device 1. In this fixed member 7B, the vertical slit 71*c* extends along the axis line of the tubular portion 71. However, respective ends of the vertical slit 71*c* do not open to the outside from the respective end surfaces of the tubular portion 71, and are positioned to the inside from the respective end surfaces. Further, two of the lateral slits 71*d* are formed in the tubular portion 71 to extend in the circumferential direction. One of the lateral slits 71*d* intersects at a center portion thereof with one end of the vertical slit 71*c*. The other of the lateral slit 71*d* intersects at a center portion thereof with the other end of the vertical slit 71*c*. The displacement portions 71*e*, 71*e* are the portions defined by the vertical slit 71*c*, and the two lateral slits 71*d*, 71*d*.

FIGS. 23 to 26 show another embodiment of a slide hinge according to the invention. In a slide hinge 1 A of this embodiment, the connecting member 85 is only utilized to connect the links 4, 5 and the intermediate member 6, and is not used to connect the intermediate member 6 and the fixed member 7. The intermediate member 6 and the fixed member 7 are connected so as to be rotatable around left end portions (one side portions) in FIGS. 23 to 26 of the cover 62 of the intermediate member 6 and the attachment plate 73 of the fixed member 7, with rotation about a rotation axis that is parallel with the shafts 85*a*, 85*b*.

Because the intermediate member 6 and the fixed member 7 being connected in a rotatable manner at the respective left end portions, the displacement portions 71*e* and the vertical slit 71*c* are provided on the left end portion (the other side portion) of the fixed member 7. Two abutting tabs 71*h*, 71*h* are formed to protrude to the inside of the tubular portion 71 at an end of an inner periphery surface of each displacement portion 71*e* that faces the vertical slit 71*c*. On the other hand, a taper (pressing portion) 61*g* that inclines along its length toward the outside from the other end side thereof to one end side thereof in the axis line direction of the main body 61 is provided in the one side portion of the outer periphery surface of the main body 61 of the intermediate member 6. Further, a straight (pressing portion) portion 61*h* is formed contiguously with one end portion of the taper 61*g* and extends parallel with the axis line of the intermediate member 6. When the intermediate member 6 is rotated from the stand-by position to the attachment position side, the taper portion 61*g* abuts with tip ends of the abutting tabs 71*h*, 71*h*, and pushes them toward the radial direction outer side of the tubular portion 71. As a result, the displacement portions 71*e* are displaced to the outside until they abut with the inner periphery surface of the attachment hole Db. Further, respective protruding plates (wedge protrusions) 71*i* formed in the other end portions of the displacement portions 71*e* are wedged into the inner periphery surface of the attachment hole Db. When the intermediate member 6 is rotated to the attachment position, the straight portion 61*h* abuts with the abutting tabs 71*h*, whereby the displacement portions 71*e* are displaced to the outside of the tubular portion 71 and held in that state. At the same time, the protruding plates 71*i* are wedged into the inner periphery surface of the attachment hole Db and held in that state. As a result, the one side portion of the fixed member 7 is fixed to the attachment hole Db so as to be immovable in the axis line direction thereof The protruding plates 71*i* have an outer side end surface that is formed in a wave shape. Accordingly, when the protruding portion 71*i* is wedged into the inner periphery surface of the attachment hole Db, the fixed member 7 is held non-rotatably in the attachment hole Db.

The intermediate member 6 and the fixed member 7 are coupled to each other at the left end portions thereof so as to be capable of rotation, and because of this the protruding plate 61*f* of the intermediate member 6 is provided at the left end portion of the main body 61. Of course, when the intermediate member 6 is rotated to the attachment position, the protruding plate 61*f* is wedged into the inner periphery surface of the attachment hole Db. As a result, the other side portion of the intermediate member 6 is fixed to the attachment hole Db.

Moreover, two engagement grooves 71*j*, 71*j* are formed in an inner periphery surface of the middle portion of the tubular portion 71 of the fixed member 7. The engagement grooves 71*j*, 71*j* are 180 degrees apart from each other in the circumferential direction. The engagement grooves 71*j* may be formed as holes that pass through the tubular portion 71. On the other hand, two engagement protrusions 61*i*, 61*i* are formed in an outer periphery surface of the middle portion of the main body 61 of the intermediate member 6. Each engagement protrusion 61*i*, 61*i* is positioned such that, when the intermediate member 6 is rotated to the attachment position, each engagement protrusion 61*i*, 61*i* is firmly fitted into each engagement groove 71*j*, 71*j*, respectively. Accordingly, when the intermediate member 6 is rotated to the attachment position, the engagement protrusions 61*i* fit into the engagement grooves 71*j*, whereby the intermediate member 6 is integrally coupled to the fixed member 7. Further, the other side portion of the intermediate member 6 is fixed to the attachment hole Db, and the one side portion of the fixed member 7 is fixed to the attachment hole Db. As a result, the intermediate member 6 and the fixed member 7 are fixed to the attachment hole Db.

Note that, the invention is not limited to the above described embodiments and permits of suitable modifications within a range that does not depart from the spirit thereof.

For example, in the above described embodiments, the other side portion of the fixed member 7 is directly fixed to the attachment hole Db, and the one side portion of the fixed member 7 is fixed to the attachment hole Db via the one side portion of the intermediate member 6. However, the displacement portion 71*e* may be provided on the one side portion of the fixed member 7, and the pressing portion 61*c* may be provided on the one side portion of the intermediate member 6. By adopting this configuration, the one side portion of the fixed member 7 may also be fixed directly to the attachment hole Db.

Moreover, in the slide hinge 1A of the latter embodiment, the intermediate member 6 is rotatably coupled to the hinge body 3 via the links 4, 5. However, the fixed member 7 may be rotatably coupled to the hinge body 3 via the links 4, 5.

In addition, in the above described embodiments, the intermediate member 6 is rotatably coupled to the fixed member 7. However, the intermediate member 6 may be coupled to the fixed member 7 so as to capable of movement in the axis line direction of the fixed member 7, or may be separated from the fixed member 7 and insertably and detachably connected to the fixed member 7.

INDUSTRIAL FIELD OF APPLICATION

The slide hinge according to the invention can be used to rotatably couple a rotating body that is comparatively light, like a wardrobe door, to a body.

The invention claimed is:

1. A slide hinge comprising:

a hinge body;

a tubular fixed member, an intermediate member that is inserted and fixed to the tubular fixed member at a predetermined attachment position, a vertical slit which is formed in the peripheral wall of the tubular fixed member and which extends across the peripheral wall in a direction along an axis of the tubular fixed member from one end surface of the peripheral wall towards the other end surface of the peripheral wall; and a lateral slit which is formed in the peripheral wall of the tubular fixed member and which extends in a circumferential direction of the tubular fixed member and is disposed adjacent the vertical slit, wherein one of the tubular fixed member and the intermediate member is rotatably coupled to an end of the hinge body via two links, a displacement portion is provided in a peripheral wall of the tubular fixed member, an end portion of the displacement portion extending in the circumferential direction is displaceable in a radial direction of the tubular fixed member, a wedge protrusion is provided on an outer peripheral surface of the displacement portion, and a pressing portion is provided on the intermediate member, the pressing portion configured to displace the end portion of the displacement portion in the direction towards an outside of the tubular fixed member when the intermediate member is inserted to the attachment position as a result of the pressing portion abutting with an inner peripheral surface of the displacement portion; and wherein the displacement portion is a portion defined by the one end surface of the periphery wall, the vertical slit and the lateral slit.

2. The slide hinge according to claim 1, wherein one side portion of the intermediate member is rotatably coupled to one side portion of the tubular fixed member such that the intermediate member is rotatable between the attachment position and a stand-by position, wherein a holding protrusion is formed in the bottom portion of the intermediate member, and wherein the holding protrusion is configured to protrude in a direction towards the outside of the tubular fixed member when the intermediate member is rotated to the attachment position.

3. A slide hinge comprising:

a hinge body, a tubular fixed member, an intermediate member that is inserted and fixed to the tubular fixed member at a predetermined attachment position, a vertical slit which is formed in the peripheral wall of the tubular fixed member and extends in the axis line direction of the tubular fixed member; and lateral slits that both extend in a circumferential direction of the tubular fixed member with an end of each of the lateral slits disposed adjacent to the vertical slit, wherein one of the tubular fixed member and the intermediate member is rotatably coupled to an end of the hinge body via two links, a displacement portion is provided in a peripheral wall of the tubular fixed member, an end portion of the displacement portion extending in the circumferential direction is displaceable in a radial direction of the tubular fixed member, a wedge protrusion is provided on an outer peripheral surface of the displacement portion, and a pressing portion is provided on the intermediate member, the pressing portion configured to displace the end portion of the displacement portion towards an outside of the tubular fixed member when the intermediate member is inserted to the attachment position as a result of the pressing portion abutting with an inner peripheral surface of the displacement portion; and wherein the displacement portion is a portion defined by the vertical slit, and the lateral slits that extend in the circumferential direction from the respective end portions.

4. The slide hinge according to claim 3, wherein one side portion of the intermediate member is rotatably coupled to one side portion of the tubular fixed member such that the intermediate member is rotatable between the attachment position and a stand-by position, wherein a holding protrusion is formed in the bottom portion of the intermediate member, and wherein the holding protrusion is configured to protrude in a direction towards the outside of the tubular fixed member when the intermediate member is rotated to the attachment position.

* * * * *